US006796068B2

(12) United States Patent
Crowson et al.

(10) Patent No.: US 6,796,068 B2
(45) Date of Patent: Sep. 28, 2004

(54) MUZZLELOADING BULLET WITH EXPANDING PIN FOR GAS CHECK

(76) Inventors: Harold Crowson, 16345 Midway Rd., Nampa, ID (US) 83651; Mike McMichael, 16345 Midway Rd., Nampa, ID (US) 83651

( * ) Notice: Subject to any disclaimer, the term of this patent is extended or adjusted under 35 U.S.C. 154(b) by 0 days.

(21) Appl. No.: 09/949,034

(22) Filed: Sep. 5, 2001

(65) Prior Publication Data

US 2002/0050224 A1 May 2, 2002

Related U.S. Application Data

(60) Provisional application No. 60/230,575, filed on Sep. 5, 2000, now abandoned.

(51) Int. Cl.[7] ..... F42B 14/00

(52) U.S. Cl. ..... 42/51; 102/520; 102/524

(58) Field of Search ..... 42/51; 102/520, 102/524, 525, 526, 527, 528

(56) References Cited

U.S. PATENT DOCUMENTS

| | | | | | |
|---|---|---|---|---|---|
| 26,016 | A | | 11/1859 | Cochran | 102/526 |
| 34,950 | A | | 4/1862 | James | 102/520 |
| 35,273 | A | | 5/1862 | Williams | 102/532 |
| 36,879 | A | | 11/1862 | Bird | 102/532 |
| 39,112 | A | * | 7/1863 | Berney | |
| 41,668 | A | * | 2/1864 | Absterdam | |
| 43,017 | A | | 6/1864 | Ganster | 102/520 |
| RE6,027 | E | * | 8/1874 | Parrott | |
| 384,574 | A | | 6/1888 | Hawley | 102/520 |
| 405,690 | A | | 6/1889 | Ball | 102/522 |
| 1,044,360 | A | * | 11/1912 | Du Bois | |
| 1,327,655 | A | | 1/1920 | Dougan | 102/522 |
| 2,389,846 | A | | 11/1945 | Ericson | 102/523 |
| 2,911,911 | A | | 11/1959 | White | 102/532 |
| 2,983,225 | A | * | 5/1961 | Walker | |
| 3,744,426 | A | | 7/1973 | Butler | 102/527 |
| 4,047,466 | A | * | 9/1977 | Berman | |
| 4,175,493 | A | | 11/1979 | Daily | 102/532 |
| 4,384,529 | A | * | 5/1983 | Burns et al. | 102/520 |
| 4,434,718 | A | | 3/1984 | Kopsch et al. | 102/522 |
| 4,549,488 | A | | 10/1985 | Hoffmann et al. | 102/522 |
| 4,587,905 | A | | 5/1986 | Maki | 102/532 |
| 5,097,615 | A | | 3/1992 | Kearns | 42/90 |
| 5,150,909 | A | | 9/1992 | Fitzwater | 102/522 |
| 5,458,064 | A | | 10/1995 | Kearns | 102/520 |
| 5,621,187 | A | | 4/1997 | Kearns | 102/520 |
| 5,915,938 | A | | 6/1999 | Moore | 42/83 |
| 5,987,799 | A | | 11/1999 | Dedeaux et al. | 42/90 |
| 6,085,454 | A | | 7/2000 | Caudle | 42/90 |
| 6,105,506 | A | | 8/2000 | Gangale | 102/439 |

FOREIGN PATENT DOCUMENTS

| | | | | |
|---|---|---|---|---|
| AT | 35741 | * | 12/1908 | 102/520 |
| CH | 488990 | * | 5/1970 | 102/525 |
| DE | 2606135 | | 8/1977 | 102/520 |
| FR | 23676 | | 12/1921 | 102/522 |
| FR | 618600 | * | 3/1927 | 102/520 |
| GB | 1667 | | 5/1868 | 102/525 |
| IT | 289179 | * | 8/1935 | 102/525 |
| IT | 299613 | * | 11/1936 | 102/525 |
| IT | 305202 | | 12/1936 | 102/522 |

OTHER PUBLICATIONS

English translation of Italy 289,179 (Breda).*

* cited by examiner

*Primary Examiner*—Stephen M. Johnson
(74) *Attorney, Agent, or Firm*—Pedersen & Co., PLLC; Ken J. Pedersen; Barbara S. Pedersen

(57) ABSTRACT

A muzzleloading bullet is provided with a pin at its back end for affixing a gas check thereto. Preferably, the pin is generally cylindrical in nature, and has a distal end that is larger compared to its proximal end that is attached to the body of the bullet. The pin therefore "expands" from its proximal to its distal end so that the resilient gas check may snap onto the pin for being secured to the bullet. Also, the expanding pin installed in a cylindrical central hole provides a small space or gap between the inner edge/surface of the central hole and the outer surface of the installed pin at one area or all the way around the pin near its proximal end. This gap increases the ease with which exploding gases from behind the gas check in the gun barrel enter the central hole of the gas check and exit between the pin and gas check when the gun is fired, which, in turn, deforms the gas check near the central hole and encourages the separation of the gas check from the bullet.

5 Claims, 6 Drawing Sheets

MUZZLELOADING BULLET WITH EXPANDING PIN FOR GAS CHECK

This application claims priority of our prior, provisional patent application, Ser. 60/230,575, entitled "Muzzleloading Bullet with Expanding Pin for Gas Check," filed Sep. 5, 2000 now abandoned, which is incorporated herein by reference.

BACKGROUND OF THE INVENTION

1. Field of the Invention

Generally, this invention relates to firearms, and bullets for firearms. More specifically, this invention relates to muzzleloading bullets with a pin at the back of the bullet for affixing a gas check thereto.

2. Related Art

This invention relates to muzzleloading bullets that have gas checks, such as the type illustrated in U.S. Pat. No. 5,458,064 (Kearns), issued Oct. 17, 1995. Kearns is incorporated herein to illustrate examples of the preferred, but not the only, structure and function of bullets with gas checks, but is not intended to limit the present invention to being applicable to only the Kearns-style embodiments. In one embodiment of Kearns, the muzzleloading bullet has a pin at its back for affixing a gas check member thereto. For this embodiment, the pin is cylindrical, and the gas check has a central, circular hole with an inside diameter slightly less than the outer diameter of the pin for frictionally engaging the pin. In this Kearns embodiment, the pin has a substantially constant diameter, and the central hole has a substantially constant diameter slightly smaller than that of the pin, so that there is contact between the pin and the hole along the whole length of the hole.

The Kearns invention has been a commercial success, and many muzzleloading bullets of its design are currently being sold. However, according to the Kearns design, if strict manufacturing tolerances are not maintained, the central hole in the gas check may be slightly oversized, relative to the pin. In this case, the bullet may be too easily separated from the gas check, and may become detached from the check in the rifle barrel, causing a possible safety hazard. Or, the central hole in the gas check may be slightly undersized, relative to that size optimum for the desired friction fit of hole around the pin. In this case, after firing, the bullet may not be separated from the gas check easily enough or at all, adversely affecting the bullet's accuracy. In any event, there is room for improvement, even on the Kearn's device.

SUMMARY OF THE INVENTION

According to the present invention, a muzzleloading bullet is provided with a pin at its back end for affixing a gas check thereto. The invention comprises providing a friction fit between a portion of the pin and the gas check, and providing a space between the pin and the gas check. The exploding gasses created by a gun being fired tend to deform the resilient gas check around the pin to release the pin from the gas check, and the pressure of the gasses between the gas check and the bullet surfaces tend to separate the gas check from the bullet. The space between the pin side surface and the gas check hole surface, according to the invention, reduces the surface area of contact between the pin and the hole wall compared to prior art bullets, and, therefore, there is less resistance to gas flow between the pin and the hole wall. The invented combination of friction fit and space is adapted so that the gas check separates from the bullet at the proper time (preferably, as soon after leaving the barrel as possible) and so that there is more room in the manufacturing tolerances for the fit between the pin and gas check.

Preferably, the space is at one or more positions on the pin circumference, or all the way around the pin circumference, preferably near the proximal end of the pin. This space(s) enhances the probability that gas will enter the central hole from the rear end of the gas check, flowing between the gas check and the pin, in effect, in an axial gas passage, which is enlarged as the gas deforms the gas check and pushes it away from the pin.

In a preferred embodiment, the adaptation to create the axial space between the pin and the gas check involves the pin being generally cylindrical in nature, and its distal end is larger than its proximal end, relative to the back of the bullet, resulting in a conical pin shape. In this sense, the pin shape "expands" from its proximal to its distal end as it extends out from the bullet. This way, when a suitable resilient gas check member is provided with a suitably-sized central hole for affixing the gas check to the pin, the hole of the gas check snaps over the pin, securely affixing the gas check to the back of the bullet. Also this way, because of the relative diameters of the pin and the central hole and because of the "expanding" structure feature of the pin, a small space or gap exists, after the gas check is affixed to the pin, between the surface of the central hole (preferably the top inner edge of the central hole) and the outer surface of the pin near its proximal end. In the case of the generally conical pin in a generally cylindrical central hole, the "small space or gap" extends all the way circumferentially around the pin. The preferred pin is enlarged ("expanded") at its distal end relative to the largest diameter of the central hole, to create a snap-on fit of the gas check on the pin.

The space/gap is important because it permits exploding gases to exit between the pin and gas check when the gun is fired, that is, it encourages exploding gases to pass from the rear of the gas check, through the central hole around the pin, to pass to the front of the gas check in between the gas check and the back of the bullet. This gas movement encourages the separation of the gas check from the bullet after firing.

Alternative embodiments of the invention provide a space or gap that does not extend circumferentially all the way around the pin. This may be done, for example, with a non-cylindrical, non-conical pin or a non-cylindrical, non-conical central hole. Many shapes of pin and central hole may be created that cooperate to temporarily hold the gas check on the pin but to also provide a space/gap between the pin and gas check to provide room for the gas flow that helps to dislodge the gas check from the pin.

While the preferred space/gap is at the proximal end of the pin (which is generally at the front end of the central hole), alternative locations may also be effective, for example, a space/gap near the middle of the axial distance between the proximal end and the distal end of the pin, or even near the distal end of the pin. As in the case of the proximally-located space/gap, such alternatively-located spaces/gaps may also work by reducing the total axial distance of frictional contact between the pin side surface and the gas check central hole surface. Thus, although the preferred embodiment places the space/gap at the proximal end of the pin, that is, downstream of the gas entry point into the central hole, alternative locations closer to the gas entry into the central hole may work. Also, the relative shapes of the pin and hole may be designed so that one or more gaps exist between the pin and the hole wall the entire length of the hole, so that exploding gasses may more easily enter the gap and then act to deform the gas check hole wall to release the gas check from the pin.

Adaptations of the pin and gas check hole may therefore comprise an axially-expanding pin such as a conical pin or an irregularly-shaped pin, and/or a conical or irregularly shaped central hole, including various combinations of these shapes. If one of either the pin member or the central hole "member" is exactly cylindrical, then the other member is preferably not exactly cylindrical, in order to create the space/gap between the two members. Because the gas check may be very thin near the central hole, the preferred central hole may also be called "generally circular" rather than cylindrical.

BRIEF DESCRIPTION OF THE DRAWINGS

FIG. 4 is a side, schematic view, including an expanded detail window (FIG. 4A), of a bullet according to the present invention being fired from a gun, wherein

DETAILED DESCRIPTION OF THE INVENTION

Figure 1:
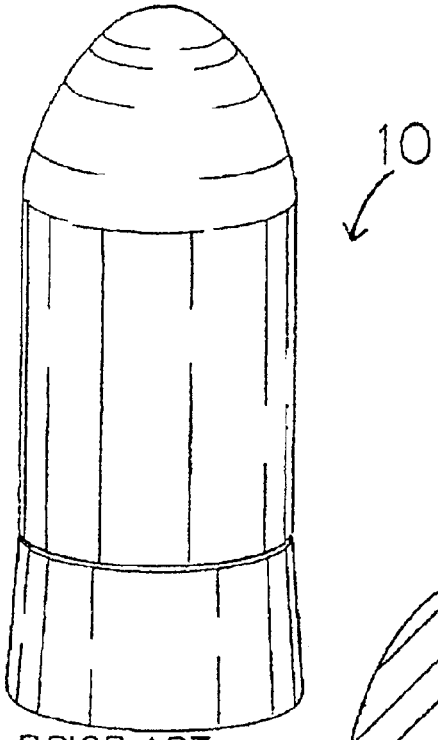
PRIOR ART FIG. 1
FIG. 1 is a perspective view of a prior art muzzleloading bullet according to the Kearns patent.
Figure 2:
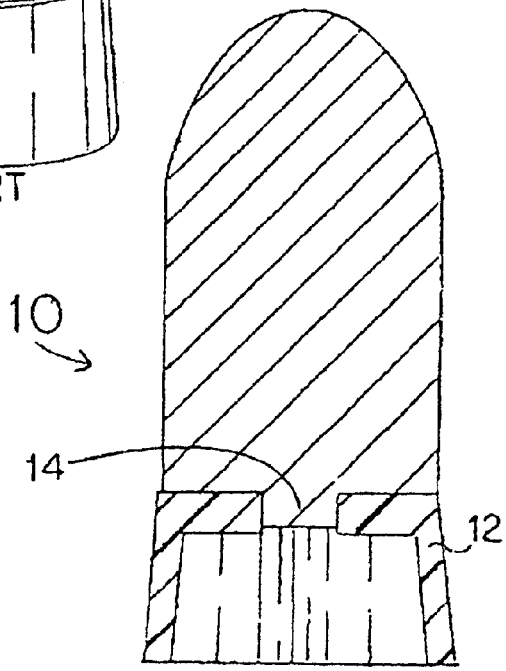
PRIOR ART FIG. 2
FIG. 2 is a cross-sectional side view of the prior art bullet depicted in FIG. 1.

Referring to the Figures, there is depicted in FIGS. 1 and 2 an embodiment 10 of a prior art muzzleloading bullet such as disclosed by Kearns. Kearns teaches how a suitably sized gas check may be installed on a suitably sized pin at the rear end of the bullet, but teaches a snug fit between the gas check and pin without spaces or gaps.

Bullet 10 has skirt-like gas check 12 affixed to its back end at rearwardly extending pin 14. Pin 14 is a substantially straight cylinder, and gas check 12 fits substantially snugly around pin 14.

Figure 3:
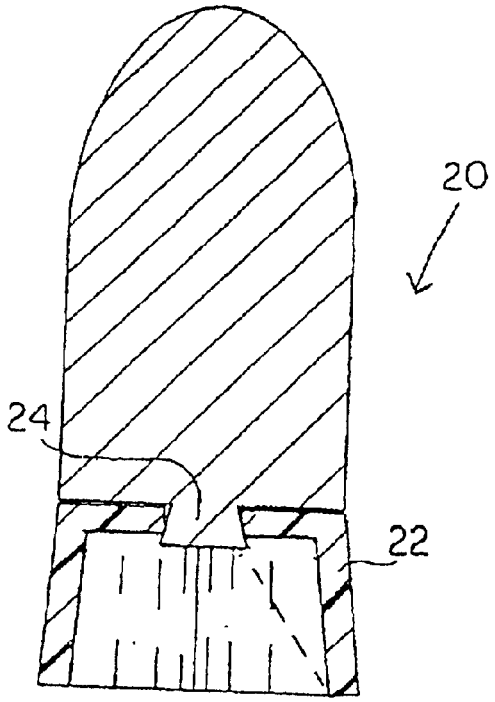
FIG. 3 is a cross-sectional side view, including an expanded detail window (FIG. 3A), of a bullet according to one embodiment of the present invention.

In FIG. 3 is depicted an embodiment of the muzzleloading bullet 20 according to one embodiment of the present invention. Bullet 20 has skirt-like gas check affixed to its back end at rearwardly extending pin 24. According to the present invention, pin 24 is a substantially truncated cone that snaps through the central hole 29 of the gas check 22. The expanded distal end 124 of the pin is larger than the proximal end 224 and larger than the diameter of the hole 29. This allows the gas check 22 to "snap" onto the pin, that is, around the pin. Also, this adapts the connection between gas check 22 and bullet so that, when gas check 22 is affixed to bullet 20, these is a gap 26 between the inner edge 28 of the central hole 29 in the gas check and the outer surface 30 of pin 24 near proximal end 224 of pin 24.

Figure 3A:
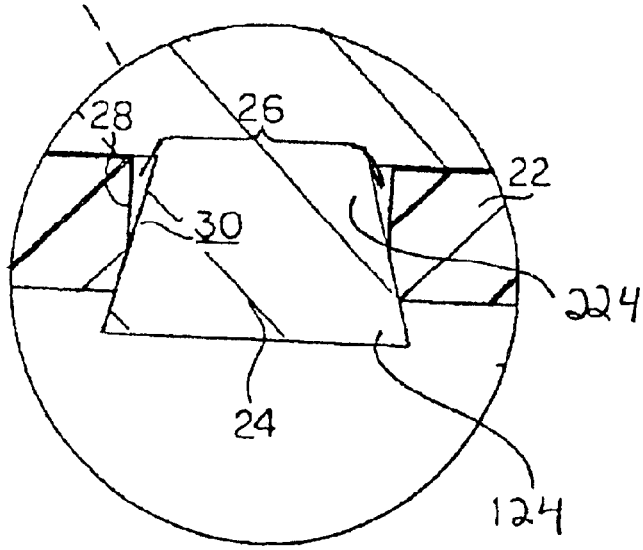
FIGS. 3B and 3C are partial, detail, side, cross-sectional views of different embodiments of the pin in a substantially-cylindrical central hole, according to the present invention.
Figure 3C:
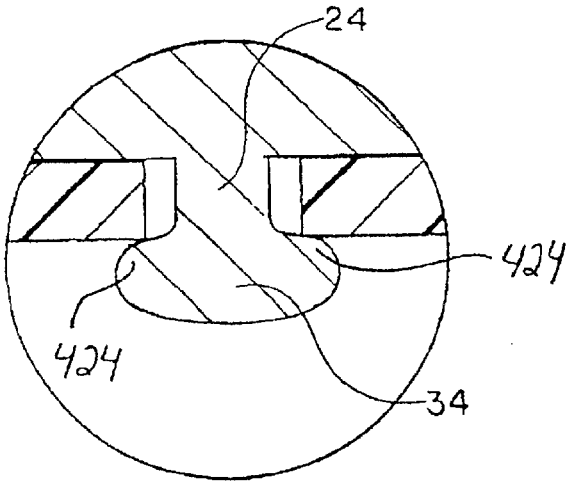
Figure 3B:
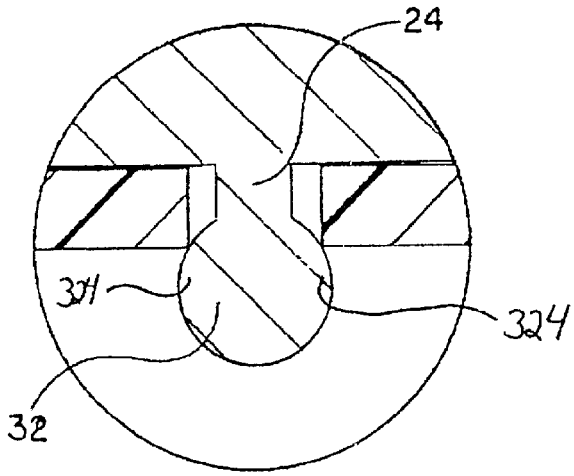

Other pin designs besides the conical or flared pin of the type shown in FIGS. 3 and 3A are considered to be within the scope of this invention. For example, pin 24 may have a knob-like head 32 as depicted in FIG. 3B. Or, pin 24 may have a pan-like head 34 as depicted in FIG. 3C. All that is necessary is that pin 24 expand in width (measured transverse to the length of the bullet) in the direction away from its proximal end nearer the back of bullet 20 towards its distal end further away from the back of bullet 20. This way, when a suitable resilient gas check member 22 is provided with a suitably-sized central hole 29 for affixing the gas check to the pin, the hole of the gas check snaps over the pin, securely affixing the gas check to the back of the bullet. The portion of the distal end of the pin that is larger than the hole extends beyond the perimeter of the hole as illustrated by portions 324 and 424 in FIGS. 3B and 3C, respectively. Also, because of the enlarged ("expanded") distal end of the pin retaining the gas check on the pin, the diameter or other transverse dimension of the proximal end of the pin need not be as large as the hole. In other words, the outer surface of the entire pin need not contact the hole wall, and a gap may therefore be present. Due to the presence of gap 26 between the hole 29 of the gas check 22 and pin 24, the hole of the gas check is permitted to deform to the extent needed to allow exploding gases through the hole around the outside of the pin, which may be called an "axial gas passage enhancement" feature. Thus, exploding gases are permitted to exit between the gas check 22 and pin 24, which exit of exploding gases encourages the separation of the gas check 22 from pin 24 and bullet 20 after the gun is fired. As illustrated by the examples mentioned below, the exploding gases may exit between the gas check and the pin because of two general types of events: 1) the small surface area of contact between the pin and the gas check is easily disrupted and parted by the gas check deforming during the explosion, which opens a channel for the gases to travel around the pin, into the gaps, and to the front side of the gas check between the gas check and the bullet; or 2) an open area of the hole not covered by the expanded end of the pin is an easy conduit for the gases into the gaps, and then to the front side of the gas check between the gas check and the bullet. Either way, the barrier to gas travel through the central hole is minimized compared to prior art designs.

Figure 4:
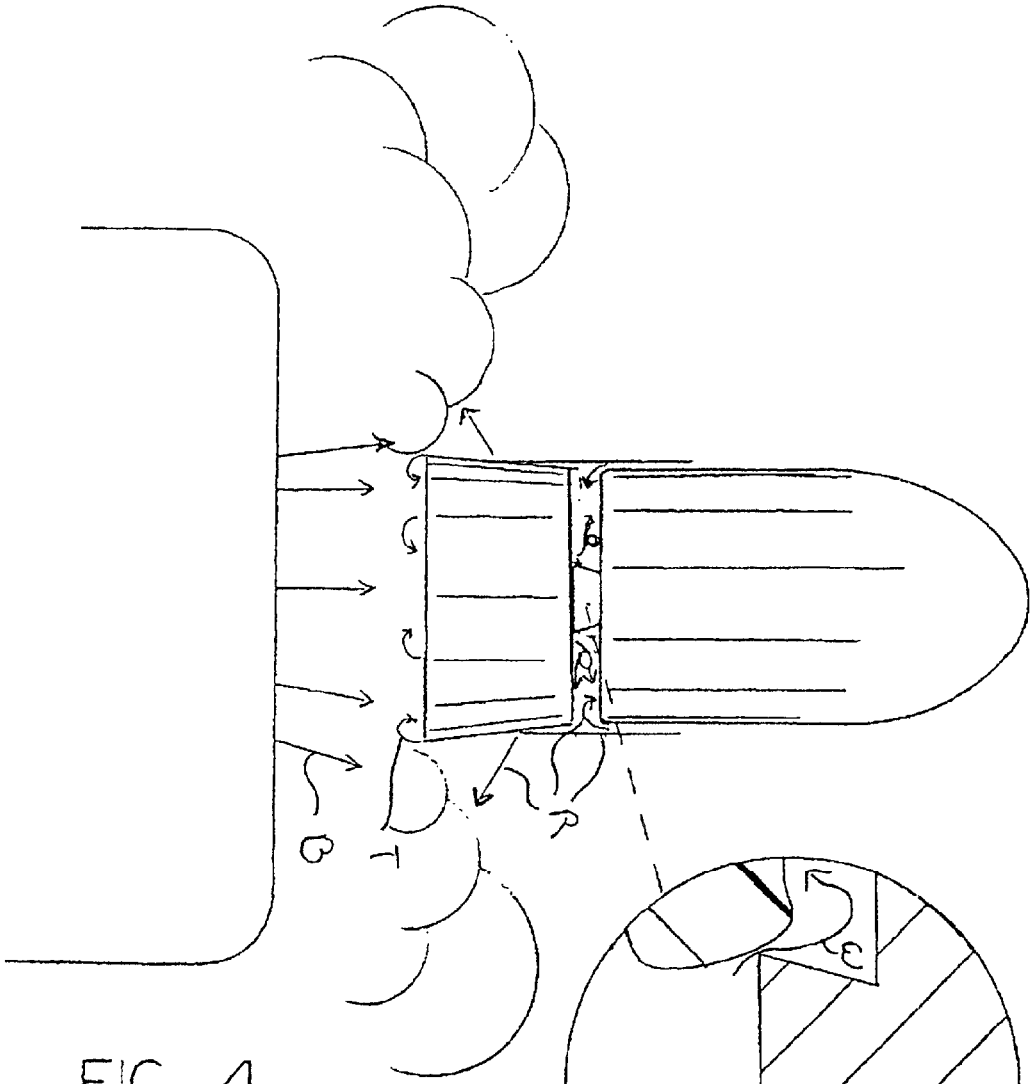
Figure 4A:
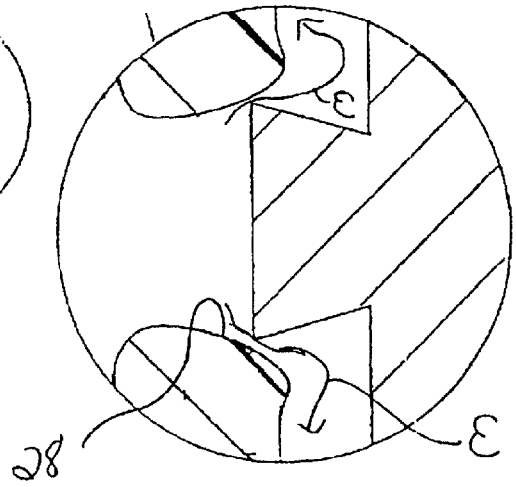
FIG. 4A illustrates the gas check around the central hole flexing to release the bullet.
Figure 5A:
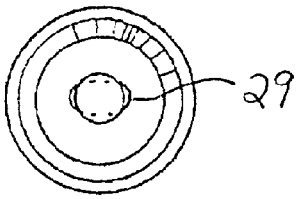
FIG. 5A is a rear view of a gas check with an oval hole according to one embodiment of the present invention, and showing an expanded distal end of the pin snapped though the hole and extending beyond the hole's perimeter.
Figure 5B:
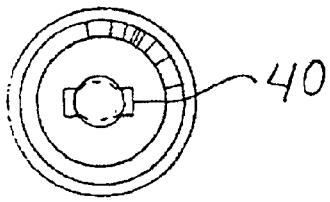
FIGS. 5B, 5C, and 5D are rear views of alternative gas checks with different hole designs, according to other embodiments of the present invention, with an expanded distal end of a bullet pin showing snapped through each hole and extending beyond the hole's perimeter.
Figure 5C:
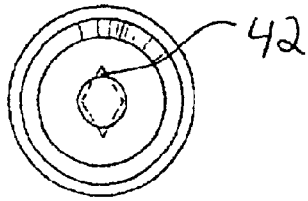
Figure 5D:
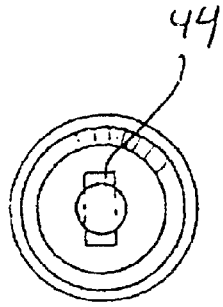

This axial gas passage enhancement feature of the present invention is depicted schematically in FIGS. 4 and 4A. There, a muzzleloading bullet 20 according to the present invention is shown exiting the barrel 36 of a gun after firing. Lines of force 38 from the muzzle blast (B), from the resisting ambient air (R), and from turbulence in the blast and the air are shown (T), and from exploding gases exiting through the central hole (E). In the expanded detail window of FIG. 4A, the deformation, especially of inner edge 28 of the central hole in the gas check, away from pin 24 is evident.

The hole 29 in the center of gas check 22 may also be adapted to maximize gap 26 between the inner edge 28 of the hole and the outer surface 30 of pin 24 near the proximal end of pin 24, and even to create a gap that extends all the way along the hole wall in some areas of the hole. For example, the holes may be irregular shapes or of very different shape than the pin, leaving gaps that extend all the way through the hole. As depicted in FIGS. 5A-5D. (looking at the bottom (rear) of the gas check toward the distal end of the pin), the holes 29 may be an oval, or a circle with rectangular cut-out portions 40, or diamond-shaped 42 or rectangular 44. This way, the gap 26 is guaranteed to exist, whenever the gas check is affixed to bullet 20 at pin 24.

Figure 6A:
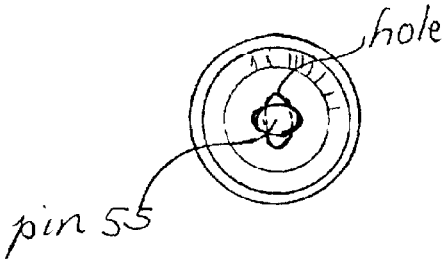
FIGS. 6A and 6B are rear views of alternative pin shapes extending through various holes, according to alternative embodiments of the invention.
Figure 6B:
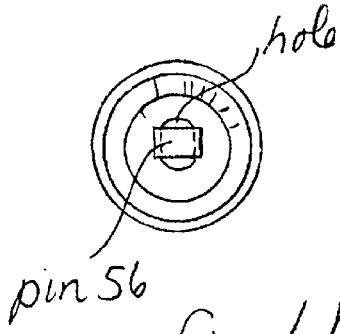
Figure 7:
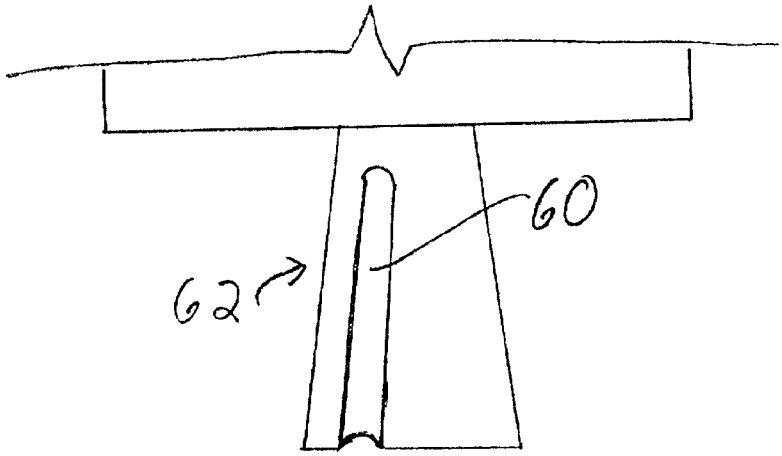
FIG. 7 is a side view of an alternative embodiment of a pin with a channel extending axially along a portion of its side surface for enhancing axial gas flow between the gas check and the pin, with the channel extending from near the distal end of the pin to near the proximal end of the pin.

Also, the pin may be made to have an irregular or non-uniform transverse dimension, for example, with an oval shape (pin 55) or rectangular shape (pin 56), when looking at the pin from the distal end, for example, as shown in FIGS. 6A and 6B. Or, as in FIG. 7, a channel 60 may be used on the side surface of a pin 62 to enhance axial gas flow immediately after firing of the muzzleloader.

Although this invention has been described above with reference to particular means, materials and embodiments, it is to be understood that the invention is not limited to these disclosed particulars, but extends instead to all equivalents within the scope of the following claims.

What is claimed is:

1. A muzzleloading bullet system comprising:

a bullet having a front end and a rear surface, an axial dimension between the front end and the rear surface, and a pin extending axially rearward from the rear surface;

a gas check having a hole defined by a hole wall, the hole receiving said pin to temporarily connect the gas check to the bullet; and wherein the pin has a side surface distanced from the hole wall to creating an axial gap between the pin and the gas check hole wall adapted to receive gas flow upon firing of a muzzleloading gun containing the bullet system;

wherein the pin is generally conical with a proximal end connected to the rear surface and a distal end away from the rear surface, wherein proximal end has a diameter and the distal end has a diameter, the proximal end diameter being smaller than the distal end diameter, and wherein the hole has an inner diameter that is smaller than the diameter of the distal end of the pin but larger than the proximal end of the pin, so that the gas check snaps around the pin when installed on the bullet; and wherein the gas check is resilient so that, upon firing, exploding gases enter the hole to flex the gas check away from the pin and flow between the gas check and the pin to reach the rear surface of the bullet.

2. A muzzleloading bullet system as in claim 1, wherein the gas check further comprises a radial portion comprising said hole defined by said hole wall and an axial skirt portion connected to the radial portion and extended rearward of the rear surface of the bullet and also extending rearward of said distal end of the pin.

3. A bullet system as in claim 1, wherein the hole is cylindrical.

4. In a muzzleloading bullet with a pin at its back end for affixing a gas check thereto, said pin extending axially rearward from the back end of the bullet, the pin having a distal end and a proximal end relative to the back end of the bullet, and the pin having an outer surface and the bullet further having a suitable resilient gas check member with a suitable-sized central hole affixed to said pin, the improvement comprising:

the distal end of the pin being larger than the proximal end, so that, when said suitable resilient gas check member is provided with said suitably-sized central hole defined by a hole wall for affixing the gas check member to the pin, the central hole wall of the gas check member snaps over the pin, and a space exists between the central hole and the outer surface of the pin, the spacee being adapted to receive gas flow upon firing of a muzzleloading firearm containing the bullet system.

5. In a muzzleloading bullet as in claim 4, said gas check member comprising a radial portion comprising said central hole defined by said hole wall and an axial skirt portion connected to the radial portion and extending rearward of the back end of the bullet and also extending rearward of said distal end of the pin.

* * * * *